US005878553A

United States Patent [19]

Schlösser

[11] Patent Number: 5,878,553

[45] Date of Patent: Mar. 9, 1999

[54] METHOD AND DEVICE FOR THE SPREADING AND FITTING OF EMPTY SACKS AND FOR GRASPING AND STACKING FILLED SACKS AND FOR CONVEYING THEM INTO A CLOSURE DEVICE

[75] Inventor: Werner Schlösser, Hennef, Germany

[73] Assignee: Chronos Richardson GmbH, Hennef, Germany

[21] Appl. No.: 728,701

[22] Filed: Oct. 11, 1996

[30] Foreign Application Priority Data

Oct. 11, 1995 [DE] Germany ..... 195 37 792.3
Oct. 11, 1995 [DE] Germany ..... 195 37 793.1

[51] Int. Cl.[6] ..... B65B 7/02; B65B 61/00

[52] U.S. Cl. ..... 53/469; 53/284.7; 198/579; 198/617

[58] Field of Search ..... 53/469, 284.7, 53/372.5, 375.4; 198/579, 599, 610, 617

[56] References Cited

U.S. PATENT DOCUMENTS

| | | | |
|---|---|---|---|
| 2,049,757 | 8/1936 | Baker et al. | 53/284.7 X |
| 2,853,842 | 9/1958 | Vrendenburg | 53/284.7 |
| 3,058,272 | 10/1962 | Huber | 53/469 |
| 4,093,083 | 6/1978 | Klaus . | |
| 4,432,186 | 2/1984 | McGregor | 53/284.7 X |
| 5,115,619 | 5/1992 | Lieder | 53/284.7 X |
| 5,398,484 | 3/1995 | Kader | 53/284.7 X |
| 5,452,567 | 9/1995 | Lieder | 53/284.7 X |

FOREIGN PATENT DOCUMENTS

| | | |
|---|---|---|
| 36 40 581 A1 | 6/1988 | Germany . |
| 41 41 253 A1 | 6/1993 | Germany . |

*Primary Examiner*—Horace M. Culver
*Attorney, Agent, or Firm*—Harness, Dickey & Pierce, P.L.C.

[57] ABSTRACT

A process and device move at least one filled sack from a suspended position at an individual filling nozzle into an upright position on a moving conveyor belt for introduction into a sack closure device, where the travel speed of the conveyor belt corresponds to the closure speed of the sack closure device, in which the at least one sack is initially transported horizontally out of an area beneath the filling nozzle before it is then deposited on the conveyor belt, and the horizontal conveying speed of the sack is greater than the travel speed of the conveyor belt.

9 Claims, 5 Drawing Sheets

METHOD AND DEVICE FOR THE SPREADING AND FITTING OF EMPTY SACKS AND FOR GRASPING AND STACKING FILLED SACKS AND FOR CONVEYING THEM INTO A CLOSURE DEVICE

BACKGROUND OF THE INVENTION

The invention relates to a method and device for conveying at least one filled sack from a suspended position at an individual filling nozzle into an upright position on a running conveyor belt for introduction into a sack closure device. In the method, the travel speed of the conveyor belt corresponds to the closure speed of the sack closure device. In the device, a clamp arrangement includes two approximately vertical arms, jointed and capable of swivelling, with clamping strips. Each clamping strip extends in the direction of the aperture edge of the sack. The arms are capable of moving in order to clamp the sack flap via the clamping strips beneath the filling nozzle by way of the closure of the clamping strips. A linear drive unit moves the clamping arrangement horizontally in the direction of the conveyor belt. A lifting unit raises and lowers the clamping arrangement. A device spreads and fits sacks onto a filling nozzle, especially flat sacks with simple flap lateral folds or of lateral fold sacks with multiple lateral folds. The sack aperture extends at one of the ends over the width of the sack. The sacks are arranged individually with the opened sack aperture pointing forwards. A pair of spreading paddles are secured to first swivel arms. The spreading paddles are capable of being introduced into the sack aperture in the vicinity of the lateral folds. The first swivel arms are capable of swivelling about a horizontal first swivel axis located above the sacks. The spreading paddles are arranged so as to be capable of swivelling about a further horizontal swivel axis which lies parallel to the forementioned first swivel axis. The spreading paddles are attached to shorter second swivel arms on a smaller radius in comparison with the first swivel arms, which, in turn, are capable of swivelling. A pair of sack grabs grasp the two lateral folds in the area of the sack aperture. Swivel arms are provided for the sack grabs which are capable of swivelling about the same horizontal first swivel axis located above the sack as the first swivel arms for the spreading paddles.

A method and a device are known from DE 92 03 380 U1. Here, sacks are filled in a suspended position at a filling nozzle and are grasped by horizontal clamping strips. After release by sack clamps arranged at the filling nozzle, the sacks are placed on a conveyor belt running beneath the filling nozzle. The sacks are first secured at that point against opening or falling over, and are then cleared for movement. In this situation, the possibility is provided of the sack aperture being grasped and closed by means of a clamping strip even before release by the sack clamps arranged at the filling nozzle. The sacks are conveyed into the sack closure device in a fully closed position which reliably avoids the possibility of the sack aperture springing open.

A problem arises here in that the travel speed of the conveyor belt must correspond to the intake speed of the sack closure device. Also, the horizontal transport speed of the sack is relatively low. The synchronized movement of the clamping arrangement, with which the sacks are held closed and secured against falling over on the conveyor belt, must also correspond with the travel speed of the conveyor belt. By contrast with the closure device, the filling unit operates on a discontinuous basis. Until the clamping arrangement has moved horizontally out of the area beneath the filling nozzle, it is impossible for another sack to be fitted onto the filling nozzle.

As a result, with discontinuous fitting and filling operations at the filling nozzle, a period of "dead" time which cannot be utilized occurs at the filling nozzle. During the "dead" time, it is not possible for another sack to be fitted onto the filling nozzle which has already emptied and been reclosed.

This disadvantage arises in particular with such devices in which two filling nozzles are arranged next to one another. Here, two sacks can be fitted in synchrony with corresponding parallel fitting devices. The sacks are then laid in synchrony on a common conveyor belt after filling and are conveyed in the same direction into a single sack closure device. In this situation, the waiting time until the next synchronized fitting operation of further sacks is increased due to the fact that one of the two sacks must not only move out of the area beneath the corresponding filling nozzle, but must also run in its entirety past the adjacent filling nozzle of the other sack, before the two fitting devices can again be used for fitting two following sacks.

A second device is known from DE 41 41 253 A1. With this device sacks are initially drawn backwards out of a sack magazine. Here, the closed sack base is located forwards in the conveying direction. The sacks are then drawn forwards. The sacks are then drawn onto an alignment table with the conveying direction reversed with the sack aperture facing forwards. The sack aperture is then opened at that point by suction devices capable of being moved apart from one another. The alignment table and the suction means are in a fixed arrangement in relation to the device. The device also includes the means for spreading and fitting the sacks onto the filling nozzle.

Double-action pneumatic cylinders are used as the drive means for the first swivel arms of the spreading paddles and for the further swivel arms of the sack grabs. In order to ensure the precise positioning of the sack grabs in relation to the aligned sacks, on the one hand, and in relation to the sack supports, on the other, this situation requires the first swivel arms for the spreading paddles and the second swivel arms for the sack grabs, respectively, to travel against spring-loaded stops. Both the pneumatic cylinders with the corresponding control elements, as well as the stops, represent relatively expensive components. In view of the fact that high acceleration and speeds are required for the swivel means, this arrangement requires the stops to absorb a considerable impact pulse. Substantial wear is incurred at the stops, and in particular at the corresponding rubber surface pads. The result is replacement at relatively short intervals. A further disadvantage during operation is the considerable noise which is incurred as the swivel means strike against the stops.

SUMMARY OF THE INVENTION

Based on this premise, one object of the present invention is to provide a process of the type described in the preamble where the filling frequency of the sacks is increased without the need to increase the movement speeds for fitting the sacks onto filling nozzle and opening and closing the filling nozzles for filling the sacks, these speeds already being designed as maxima.

The solution includes a process where the at least one sack is first transported horizontally away from an area beneath the filling nozzle before it is placed on a conveyor belt. Also, the horizontal conveying speed of the sack is greater than the travel speed of the conveyor belt.

In this situation the horizontal conveying speed of the filled sacks for the first part of its horizontal travel is disassociated from the travel speed of the conveyor belt, at least until the sacks have moved out from the area beneath the filling nozzle (S). Only then are the sacks placed on the conveyor belt. The travel speed of the conveyor belt corresponds to the intake and processing speed of the sack closure device. The time which is gained in the sequence of fitting new sacks takes effect particularly in such devices in which two filling nozzles are arranged in parallel with one another. In this case, the travel distance beneath the filling nozzles for the rear sack in the conveying direction is particularly great in each case.

The essence of the process accordingly lies in the fact that the sacks are initially conveyed in a suspended or semi-suspended supported position over part of the conveying distance, without as yet having contact with a conveyor belt. In the case of light and small sacks, this suspended position can only be secured by clamping the sack flap by the clamping strips. With larger and heavier sacks, it is possible to modify the supported position via support means which support the sacks from the sides or from below. The means moving horizontally together with the clamping strips, in terms of height, still being located above the conveyor belt.

In order to release the sack flap from the filling nozzle after filling, it is preferably the sack or sacks are moved initially into a slightly lowered position. After lowering the transverse conveying of the sacks is in a suspended or supported position. Finally the sack or sacks are lowered onto the conveyor belt again outside the area beneath the filling nozzle (S).

It follows from this that the process according to the invention can be carried out on systems of the state of the art indicated by the appropriate modification of the control system and with the appropriate guidance of the clamping strips.

An especially well-suited device for carrying out the process is characterized in that the start end of the conveyor belt, in relation to its direction of travel, is located outside an area beneath the filling nozzle. This improves the access to the filling nozzle and the fitting devices. In a further preferred embodiment, it is possible for a height-adjustable vibrating device, for at least one filled sack, to be arranged beneath the filling nozzle. This device can occupy the free space created by relocating the start end of the belt. The device can be moved against the base of the sack from below during the filling process in order to support the filling process in a known manner by vibration. Due to the height adjustment capability, it is possible to adapt to sacks of different sizes without special conversion measures.

A further improved embodiment provides a support arrangement for at least one sack with two horizontal closeable support chucks. The chucks close from the sides in the area of the sack body of the sack which is clamped by the clamping strips on the sack flap. The chucks are capable of movement in synchrony with the clamping arrangement by the linear drive unit. This arrangement prevents, in the first instance, undesirable swinging or oscillating of the sacks during their horizontal movement. However, it is also possible to provide retaining forces, for example by means of the appropriate rubber covering of the support chucks. An advantageous embodiment in this situation makes provision for the support chucks to feature angle elements facing inwards, located at the lower edges, on which the base of the clamped sack can rest. This incurs a further reduction in the carrying forces which are to be accommodated by the clamping strips.

In view of the fact that the support clamps are arranged at a fixed height and that the clamps close in order to secure the sack body simultaneously with the closure of the clamping strips to clamp the sack flap, when the holding arm is lowered, the strain is relieved on the sack flap clamped between the clamping strips. As a result of this, the sack can be deposited on the conveyor belt after being moved horizontally by the support clamps opening, without any tensile force taking effect on the sack flap clamps between the clamping strips. This also insures that the sack flap is drawn into the following intake device of sack closure device, respectively, free of tensile forces.

Further improved embodiment provides intake devices at a start end of the sack closure device and above the conveyor belt which are divided in a first intake device and a second intake device. The first intake device, in the sequence of sack transfer, can be opened while the second intake device, in the sequence of said transfer, is still closed. The intake devices are driven at the speed of the conveyor belt and are comprised of pairs of circumferential belts. The improvement being that the first intake device is prepared for taking another at least one sack coming in at a high speed in a suspended or supported position, while the second intake device is still guiding an at least one previous sack into the closure device at a lower speed in a standing position. Both pairs of circumferential belts of the first and the second intake device may open and close in a parallel movement or at least the one of the first device in a V-shaped movement.

It is to be understood that the term "conveyor belt" also means in the wider sense, powered roller trains and similar stationary conveying means.

A further object of the invention is to provide a drive system for the swivel means which is simple in design and improved in performance. A solution for this includes a crank drive for driving the first swivel arms. The crank drive includes a crank-and-rocker mechanism with a rotating crank arm on the drive side and a swivelling crank arm on the output side. The arms are connected with one another by a thrust rod.

A drive of this type is easily created. The drive can be suitably implemented by an electric motor provided with a brake. The motor may be controlled by means of simple electrical control means, for example end contacts actuated by the swivel means. The end positions of the swivel means are precisely specified by the kinematics of the drive. Acceleration and deceleration are entirely absorbed in the drive itself. Even when accommodating very high acceleration and deceleration values of the drive crank which may be attained with a suitably high reduction from the electric motor to the drive crank, because of the circular function of the drive crank, the pulses from the swivel means resulting from acceleration and deceleration on reaching the end positions are low. This is due to the reduction in the speed of the thrust rod at the turning points.

As is known from the prior state of the art, it is preferable for the first swivel arm for the spreading paddles and the other swivel arms for the sack grabs to be connected to one another. The result is the drive means according to the invention relate to a common drive. In this situation, especially the first swivel arms for the spreading paddles and the swivel arms for the sack grabs can be arranged in a fixed manner on a common rotating beam.

The means for the smaller and lighter drive for the second swivel arms of the spreading paddles, which are moved in synchrony by the first swivel arms, are represented for weight and spacial reasons in the known manner by double-action pneumatic cylinders.

According to a first design embodiment, the swivelling crank arm on the output side may be mounted on the first swivel axis, and, as an angled lever, is fixedly connected to the first swivel arm. As a simplification of this, alternatively, the swivelling crank arm on the output side may be formed by the first swivel arms themselves.

In another embodiment of the invention, the filling nozzle, which as such is known, is capable of swivelling about an axis of rotation $X_5$ parallel to the swivel axis $X_1$. Also, the filling nozzle is capable of swivelling out of vertical filling position $A_1$, with its mid axis A, into an inclined fitting position $A_2$, which is tangential in relation to the swivel path $B_1$ of the spreading paddles and the sack grabs, about the first swivel axis $X_1$. This swivelling movement of the filling nozzle into the swivel path of the spreading paddles and sack grab facilitates the fitting of the sacks onto the sack support. As soon as the sack is secured by clamping means at the sack support, and the spreading paddles move out of the sack aperture, and the sack grabs are opened at the swivel means, the filling nozzle is swivelled back again into a position with a vertical axis, for the actual filling process.

In another embodiment, a crank drive for driving the filling nozzle is in the form of a crank-and-rocker mechanism. A rotating crank arm is on the drive side and a swivelling crank arm is on the output side. The arms are connected to one another by means of a thrust rod. The same advantages with regard to simplified design of the drive means for swivelling the filling nozzle, as well as with regard to the functional improvement of the appropriate movement sequences, are derived here in the same way as with the drive system of the same composition for the swivel means, as described previously.

More favorably in a further design, the rotating crank arm for the drive on the first swivel arms and the further swivel arms and the rotating crank arm for the drive of the filling nozzle are synchronized with one another and driven by the same drive motor, and, in particular, are located on the same drive shaft. This enables both for the number of drive motors and the corresponding control units to be reduced to 1, with complete synchronization of the movement sequences of the swivel arms and the filling nozzle being achieved simultaneously.

A further solution includes the means for driving the first swivel arm and the further swivel arm, on the one hand, and the means for driving the filling nozzle, on the other hand, to be mechanically coupled and provided with joint drive elements, such as drive cylinders or a drive motor.

As a result of a common drive, it follows that the two swivel movements of the filling nozzle and the swivel arms, respectively, will in each case take place simultaneously. A certain pre-emption of the one swivel movement in relation to the other, with regard to reaching their end position, can be permitted, but it is preferable for the two drives to be coupled in such a way that the end positions are reached in synchrony.

In order to open each sack arranged on the feed belt, initial suction means are arranged for preference, which are capable of holding the lower wall of the sack, in the vicinity of the aperture. Second suction means are capable of holding the upper sack wall. The two suction means are capable of being subjected to vacuum and are capable of moving apart from one another. In a subsequent movement process, the spreading paddles are introduced. This can be followed by a joint rapid swivel movement of the sack grabs and the spreading paddles on an arc towards the filling nozzle. The sack grabs include pairs of claws, which can be opened and closed by their swivel motion.

The device described here is suitable, on the one hand, to hold the lateral sack folds under control against spreading open, but at the same time prevent the spread sack aperture from closing up even at rapid fitting speed. Due to the present invention, this will be assured throughout the entire fitting process, until the sack is clamped onto the filling nozzle. To achieve this provision is made for the spreading paddles to complete their action in synchrony with swivel motion of the sack grabs from the feed belt through to the filling nozzle. Due to the fact that, when the sack is fitted, the spreading paddles are located inside the sack aperture laterally from the filling nozzle, they do not impede the sack clamps at the filling nozzle, since they can be moved upwards out of the operating range of the sack clamps at the filling nozzle, by the further swivelling movement of their second swivel arms.

Advantageously, the spreading paddles can only be removed in a position on the sack aperture in which the sack aperture has already been moved above the filling nozzle and the spreading paddles can be swivelled back, with the sack still clamped, into their initial position on the feed belt, together with the swivel means, in order to accommodate the next sack.

BRIEF DESCRIPTION OF THE DRAWINGS

A preferred embodiment of the invention with two filling nozzles is described hereinafter on the basis of the drawings.

The drawings show specifically.

DETAILED DESCRIPTION OF THE DRAWINGS

Figure 1:
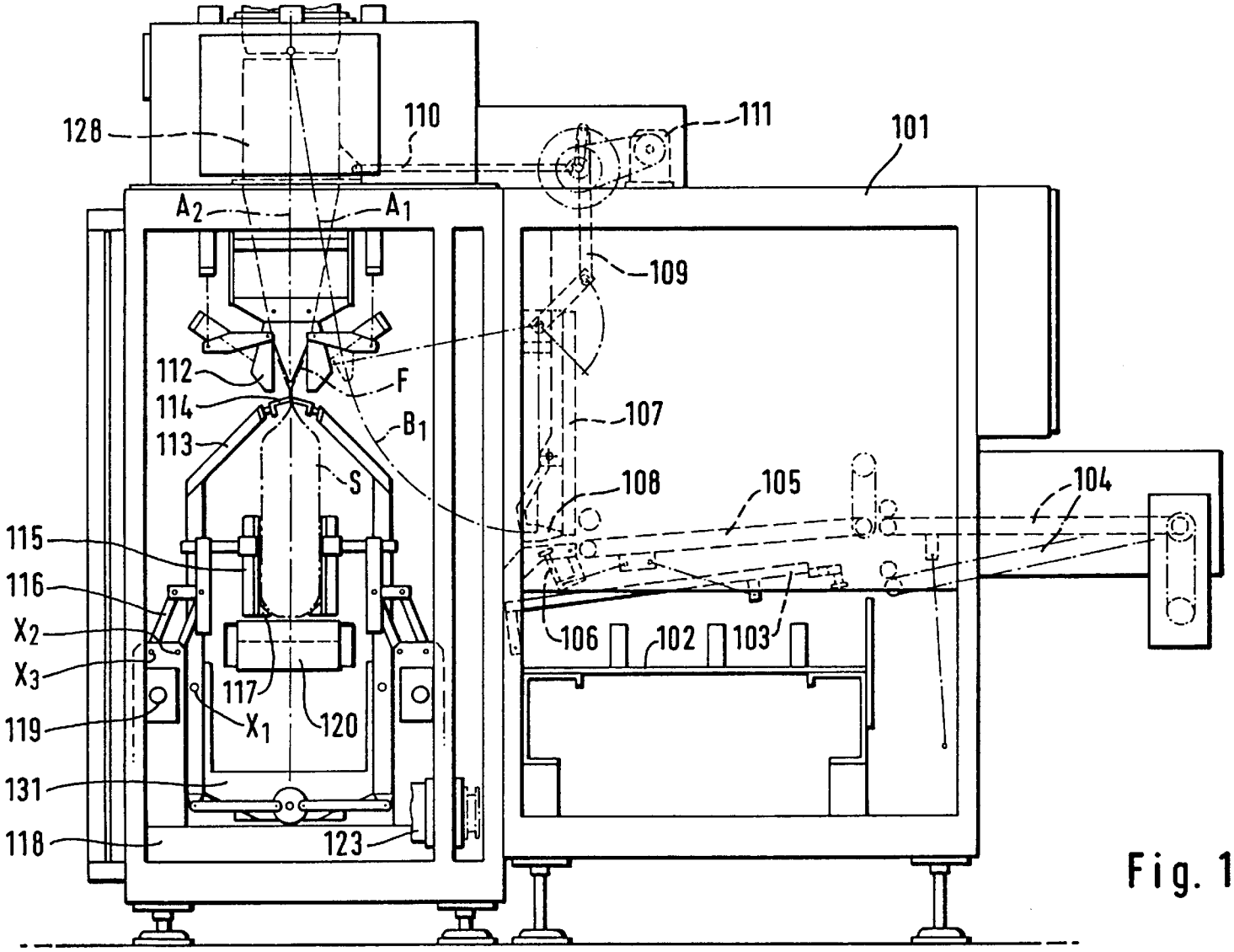
FIG. 1 is an elevation view of the device in the conveying direction of the conveyor belt.

FIG. 1 illustrates a multi-component frame 101 in which a sack magazine 102 is arranged to accommodate a stack of sacks. The sack apertures are located on the left-hand side. Individual sacks are raised in the area of their bases by a grab arm 103, which can be swivelled and moved outwards, and are drawn into an intake device 104. This device is capable of being swivelled upwards into the second position shown, and is reversible in its direction of drive. From the upper position, the individual sacks are now conveyed into a feed device 105, with their apertures facing forwards. At that point, the sack aperture is spread open by suction means 106, which is capable of swiveling. A swivel arm 107 with spreading paddles 108 and grabs (not shown) engage the sack aperture at that point and convey it along the arc $B_1$ until it is above a filling nozzle 128. A drive arrangement with two crank drives 109, 110 and a common drive motor 111 causes both the arm 107 to swivel as well as the filling nozzle 128 to swivel inwards into the axial position $A_1$, tangential to the arc $B_1$. At the filling nozzle 128, sack clamps 112 can be seen, arranged in pairs, which are capable of clamping the sack flap F at the filling nozzle. Below the filling nozzle 128, which after the sack has been fitted, is returned into the vertical position designated as $A_2$, is a clamp arrangement with two arms 113, which are capable of being swivelled in synchrony about initial axes $X_1$. On the upper ends of the arms 113, clamp strip pairs 114 are provided for the direct clamping of the sack flap F below the filling nozzle. In addition support chucks 115 engage on the suspended sack S, which are capable of clamping and supporting the sack by means of the parallelogram lever 116. The chucks 115 each have support angle elements 117 on their lower ends. The parallelogram levers 116 are capable of slowing about the axes $X_2$, $X_3$. The said axes $X_1$–$X_3$ are held in an essentially U-shaped bridge 118, which is guided on spindles or cylinders 119, which are part of a linear drive unit. A conveyor belt 120 can be seen beneath the sack S.

Figure 2:
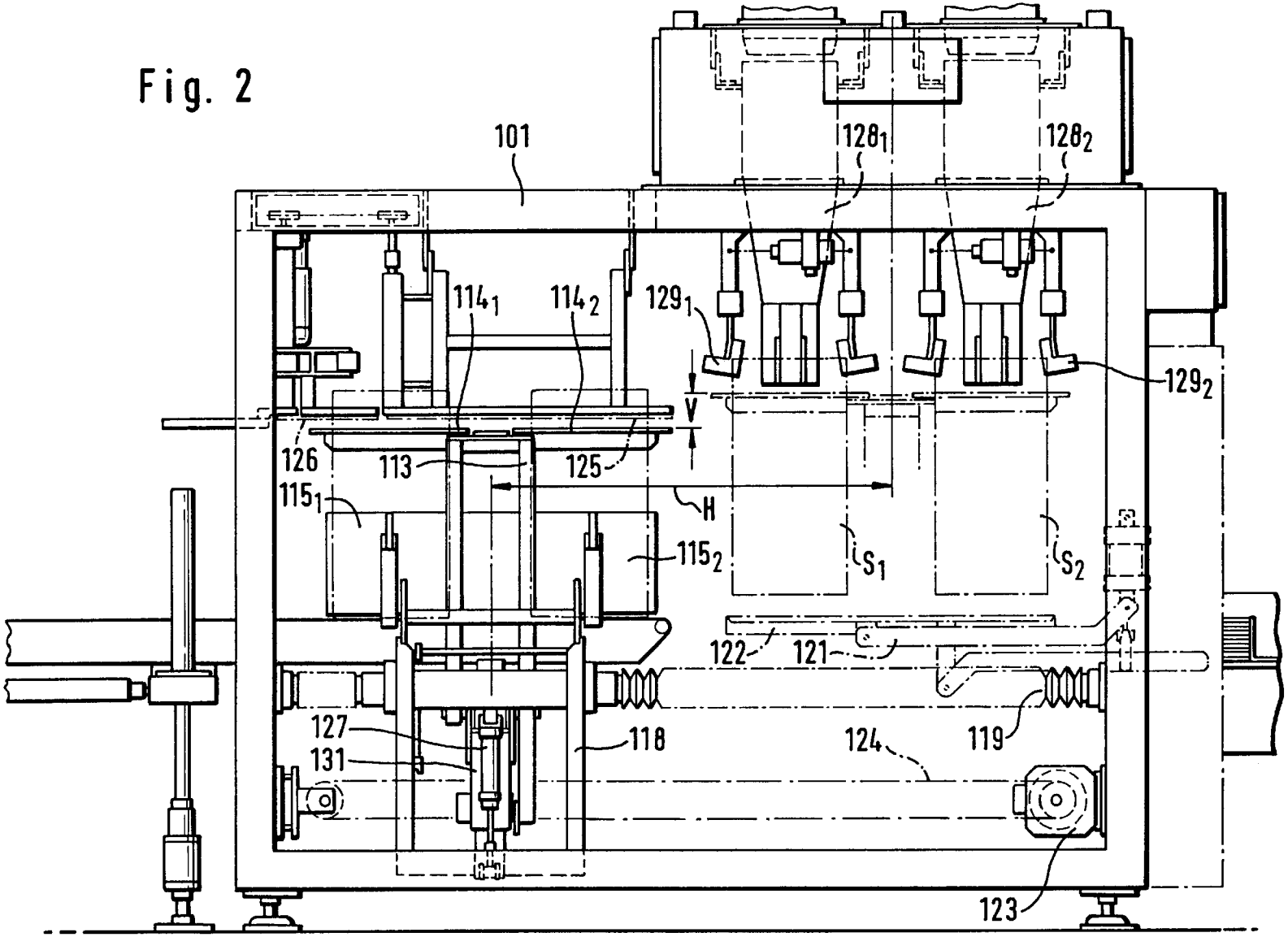
FIG. 2 is a side view of the device according to FIG. 1.

FIG. 2 shows the frame 101 in a side view. It can be seen here that two filling nozzles $\mathbf{128}_1$, $\mathbf{128}_2$ are arranged next to each other in the frame 101, each of which are provided with further pairs of sack clamps $\mathbf{129}_1$, $\mathbf{129}_2$ which act upon the front surfaces of the filling nozzles. A sack vibration device 121 can be seen beneath the sacks $S_1$, $S_2$ in their suspended position, with a height-adjustable vibrating table 122. In addition to this, the cylinders 119 are shown, as well as a drive motor 123 for a belt drive 124, which is capable of being moved horizontally in the frame with the U shaped bridge 118. Lateral lifting cylinders 127 are used to raise a carriage 131 vertically inside the bridge 118.

Identifiable on this carriage are the retaining arms 113 with clamping strip pairs $\mathbf{114}_1$, $\mathbf{114}_2$. As is indicated by a horizontal arrowhead H, the bridge 118 can be moved horizontally between their position as shown and a position indicated by a broken line, these positions being located far enough apart from one another that the two sacks $S_1$, $S_2$ moved entirely out of the area beneath the filling nozzles $\mathbf{128}_1$, $\mathbf{128}_2$. As indicated by a vertical arrowhead V, the arms 113 can be moved vertically in such a way that the clamping strip pairs $\mathbf{114}_1$, $\mathbf{114}_2$ can be moved out of a position initially adopted at the filling nozzles into a second lowered position opposite the support clamp pairs $\mathbf{115}_1$, $\mathbf{115}_2$. By opening the support clamp pairs $\mathbf{115}_1$, $\mathbf{115}_2$, the sacks are lowered onto the conveyor belt in which situation the clamping strip pairs $\mathbf{114}_1$, $\mathbf{114}_2$ initially remain closed.

Arranged laterally outside the area of the filling nozzle $\mathbf{128}_1$, $\mathbf{128}_2$ and above the clamping strip pairs $\mathbf{114}_1$, $\mathbf{114}_2$, in their lefthand end position, are intake devices 125, 126, with which the sack apertures are engaged and can be moved into a sack closure device located on the left, in which situation the upper sack edges are again released by the clamping strip pairs $\mathbf{114}_1$, $\mathbf{114}_2$.

Figure 3:
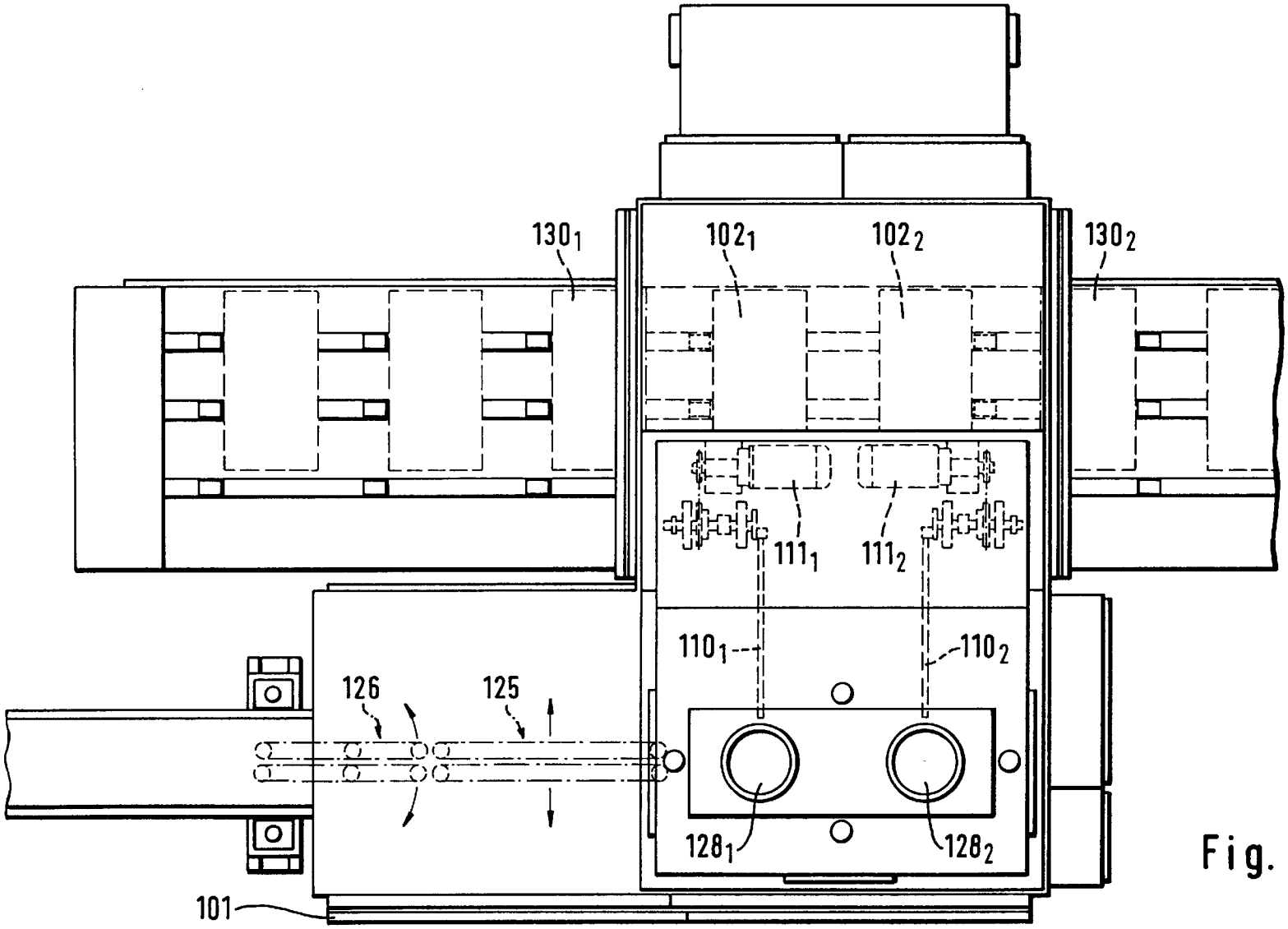
FIG. 3 is a vertical view of the device according to FIG. 1.

FIG. 3 shows the approximately L-shaped frame 101 in a plan view, in which it can be seen that two sack magazines $\mathbf{102}_1$, $\mathbf{102}_2$ are provided, each of which encompasses a number of cassettes $\mathbf{130}_1$, $\mathbf{130}_2$, arranged on circumferential belts. Also shown are two drive motors $\mathbf{111}_1$, $\mathbf{111}_2$ with crank drives $\mathbf{110}_1$, $\mathbf{110}_2$ for the two filling nozzles $\mathbf{128}_1$, $\mathbf{128}_2$. The means for fitting and horizontal conveyance of the sacks are not shown in detail. However, the intake devices 125, 126 are shown. Arrows indicate that the conveyor belt of the first intake device 125 open in parallel, while the intake belts of the second intake device 126 open in a V-shape.

Figure 4:
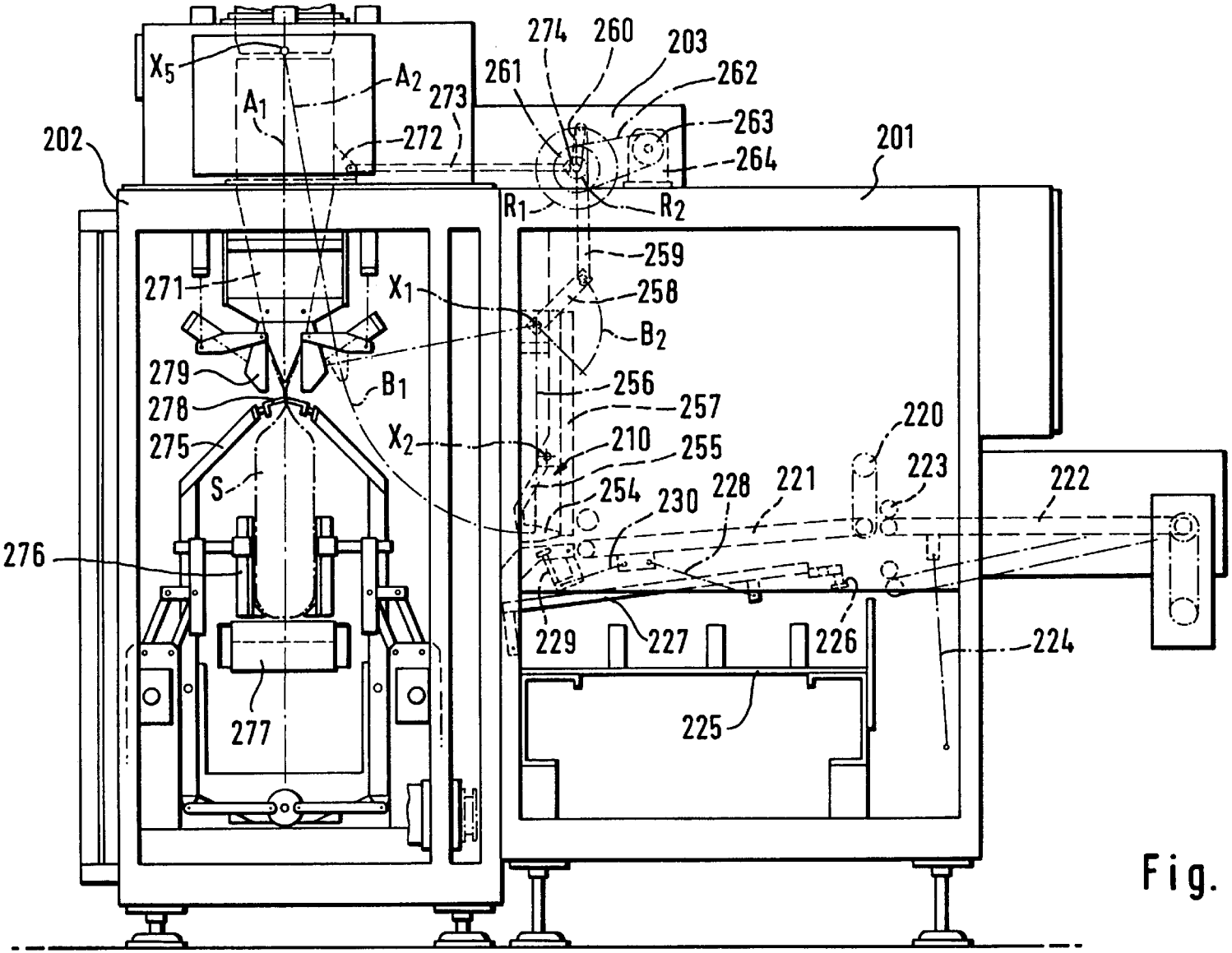
FIG. 4 is an elevational view of the device according to the invention according to FIG. 1 with further reference numbers.

FIG. 4 shows a first machine frame 201 in a side view, in front of which a second machine frame 202 can be seen in a front view. Both are connected to one another in a fixed arrangement and by means of a drive arrangement 203.

Located in the first machine frame 201 are initial swivel arms 257, on the lower free end of which sack grabs 210 are secured, explained in greater detail hereafter. The swivel arms 257 are mounted on bearings so as to swivel about an axis $X_1$. In the swivel arms 257, two shorter swivel arms 255 are capable of slewing about a second axis of rotation $X_2$, parallel to the axis of rotation $X_1$. The swivel arms 255 are actuated by means of an actuating cylinder 256, represented only symbolically. Spreading paddles 254 are secured to the free ends of the swivel arms 255. A crank arm 258 is secured at an angle to the first swivel arms 257, this being part of a crank drive in the form of a crank-and-rocker mechanism. Connected to the free end of the crank arm 258 is a thrust rod 259 which, in turn, is linked to the free end of a crank arm 260. The crank arm 260 is driven by a drive pulley 261, which is driven by means of a belt 262 from a drive pulley 263 of a drive motor 264. $R_1$ indicates the path of the point of connection of the thrust rod 259 on the crank arm 260. $B_2$ indicates the arc of the point of connection of the thrust rod 259 on the crank arm 258. When the latter point of connection passes through the arc $B_2$, the spreading paddles 254 on the swivel arm 257 move on the arc $B_1$. The spreading paddles 254 can, in addition, be moved on a second arc, not shown, when swivelled about their swivel axis $X_2$.

In the machine frame 202 a filling nozzle 271 can be seen as part of a sack filling system. The nozzle is capable of swivelling about an axis of rotation $X_5$. The filling nozzle 271 longitudinal axis is capable of being swivelled out of vertical filling position $A_1$ into an inclined fitting position $A_2$, which runs as a tangent to the arc $B_1$ which defines the swivel path of the spreading paddles 254. A tongue 272 is formed at the nozzle 271. The unit formed from the support 271 and tongue 272 forms a crank arm in relation to the axis of rotation $X_5$. The crank arm is engaged by a thrust rod 273. A short crank arm 274 is located at the free end of the thrust rod 273. The crank arm 274 is driven by the drive pulley 261. The path of the point of connection of the thrust rod 273 is designated as $R_2$. The two crank arms 260, 274 are in each case arranged in relationship to the longitudinal direction of the thrust rods 259, 273 in such a way that the swivel arms 257 adopt their lower end position to accommodate a further sack when the filling nozzle 271 is in its vertical axial location $A_1$ for filling a sack. The swivel arms 257 then adopt their opposite end position for fitting a sack when the filling nozzle with the axial position $A_2$ is swivelled into the swivel path $B_1$ of the spreading paddles.

Further details identifiable in the frames will now be described, which form part of the device as a whole, without forming part of the object of the invention.

The introduction of a sack in the frame 201 is essentially brought about by a belt loop 221. The belt is driven by a drive motor 220. Located behind the feed belt 221 is sack intake device 222. The front drive roller 223 can be driven in both directions. It can be swivelled as a whole between the upper position indicated by a broken line and the lower position indicated by a line of dots, by means of an actuating cylinder 224, represented symbolically. In the lower position an individual sack can be taken out of a sack magazine 225 by the sack intake device 222. A suction means 226 is lowered onto a sack stack, not represented a vacuum being imposed, and the device then being raised again. To do this, a swivel arm 227 is provided above the sack magazine 225. The swivel arm 227 is capable of carrying out a swivel motion via a lifting cylinder 228, shown symbolically. The suction means 226 are capable of displacement longitudinally in relation to the swivel arm 227. When the suction means are moved out of the position shown, the sack base located in the front will be taken up by the intake roller 223 of the intake device 222, and can be drawn in. The intake device 222 is then brought into the upper position, and the direction of drive is reversed. The sack is moved forwards on the feed belt 221 in a precise position. At that point the sack aperture can be opened by suction means 229, actuated by power cylinders 230, of which only the lower units are shown.

The onwards conveying of a sack S in the frame 202 after filling is effected after clamping chucks 279 on the filling nozzle 271 open. The sack flap is engaged by clamping strips 278 arranged on the retaining arms 275. The sack S is supported by moving retaining chucks 276. Drive components of the retaining arms 275 and the chuck 276 are shown, but are not explained in further detail. The sack S can be deposited by these elements on a conveyor belt 277. The retaining arm 275 and the retaining chuck 276 are capable of being moved together with the sack along the conveyor belt 277.

Figure 5B:
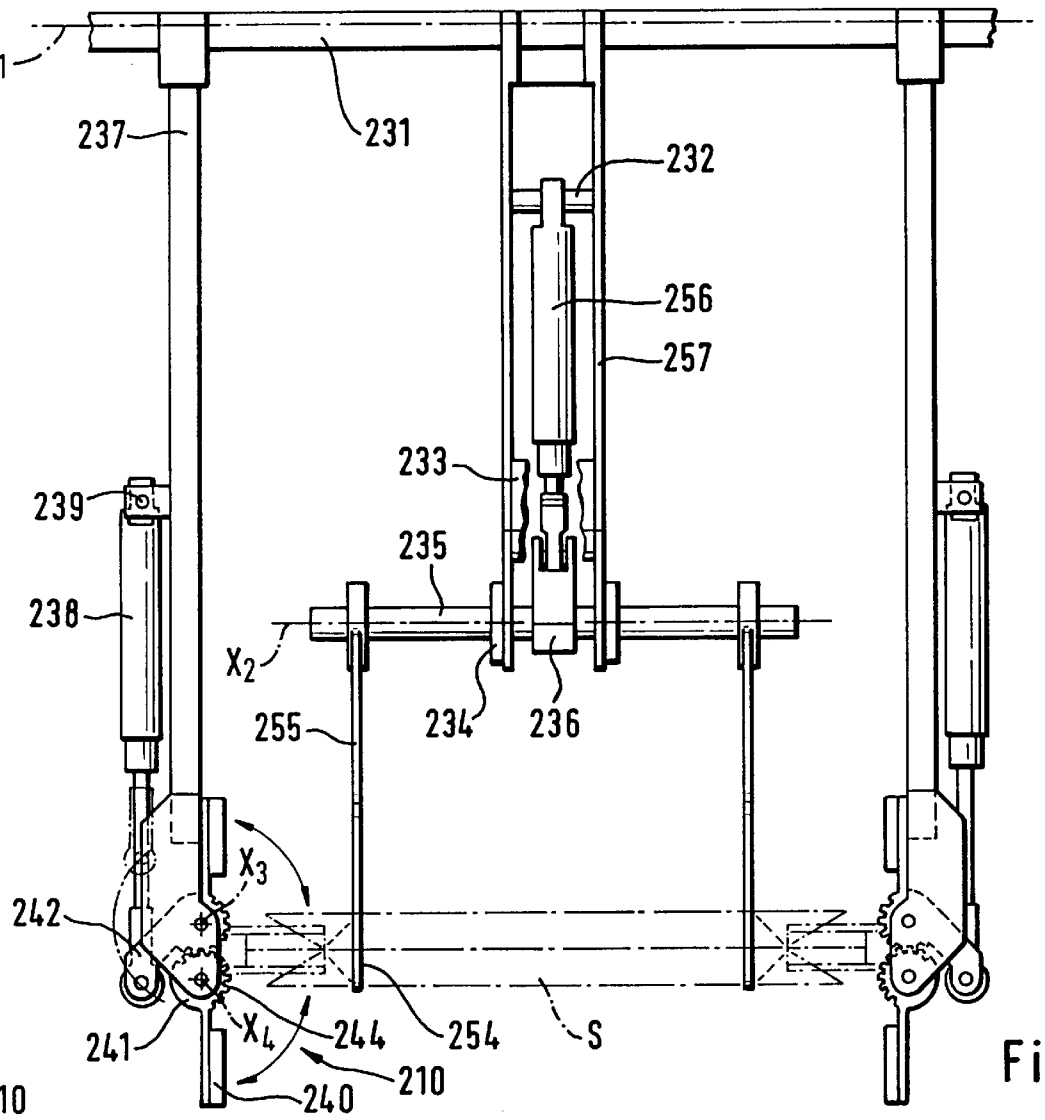
FIG. 5*b* is a front elevational view of the swivel means according to FIG. 5*a*.
Figure 5A:
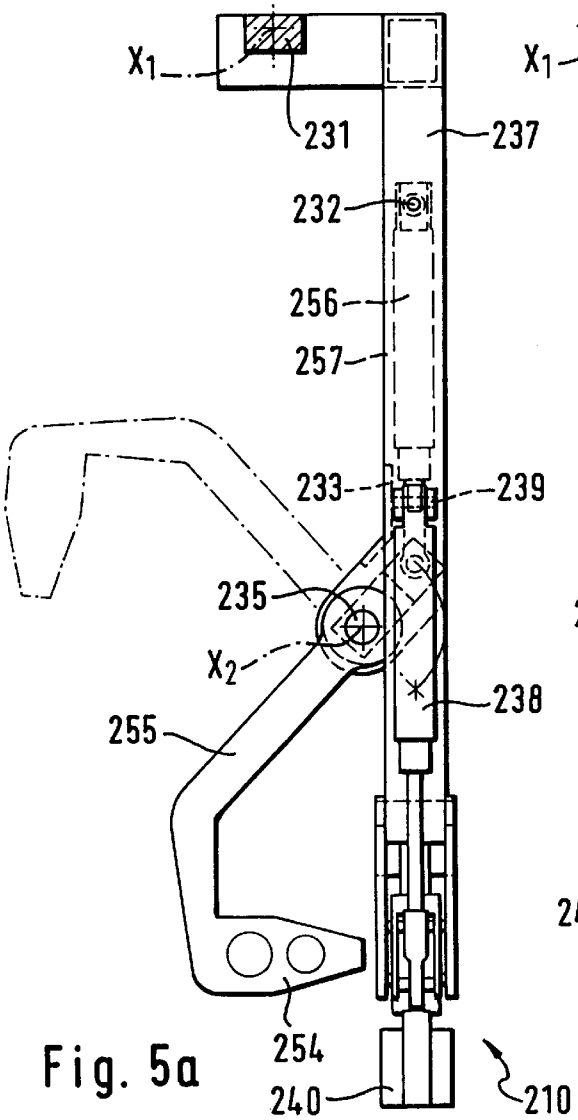
FIG. 5*a* is an elevational view of the swivel means with sack grabs and spreading paddles according to FIG. 4 as an enlarged detail.

In FIG. 5*a*, details from FIG. 4 are shown in an enlarged side view. FIG. 5*b* is a front view of FIG. 5*a*. Both figures are described hereinafter jointly.

The power cylinder 256 and shorter swivel arms 255 with the with the spreading paddles 254 are arranged on the swivel arms 257. The arms 257 are secured to a rotating beam 231, and are connected by this to one another and above one another by means of an initial stewing journal 232 and connecting tongue 233. A rotating axle 235 is mounted on front bearing bushings 234. The axle directly supports the arms 255, and is rotated by means of the lever 236 of the power cylinder 256. The axle 235 can rotate about the axis of rotation $X_2$ for the spreading paddles.

Swivel arms 237 are likewise provided in pairs, which in the side view cover the cylinder 256. These swivel arms 237 are likewise connected to the rotating beam 231 in a rotationally-resistant manner. No further connection between them is provided. On the outside of the swivel arm 237 further power cylinders 238 are mounted in journal bearings 239.

The cylinders are used to actuate the pairs of sack clamps 210. Sack clamps 210 include pairs of claws 240. The claws 240 are capable of slewing on rotational bearings 241 about parallel axes of rotation $X_3$, $X_4$. Only one of the journals for one is capable of being driven directly in each case by a lever 242. The rotating journals engage with one another by means of teeth 244. The journals are driven counter-directionally by the power cylinders 238. As a result of this, the claws 240 can be swivelled into the closed position represented by the broken line. The sack S is represented with broken lines, in this case in particular as a lateral fold sack, into which the spreading paddles are introduced.

While the above detailed description describes the preferred embodiment of the present invention, the invention is susceptible to modification, variation and alteration without deviating from the scope and fair meaning of the subjoined claims.

I claim:

1. A method for conveying at least one sack, having a wall with a closed end and an open end, said open end when closed forming a flap sack, from a suspension position to an individual filling nozzle into an upright position on a moving conveyor belt for introduction into a sack closure device, wherein the travel speed of the conveyor belt corresponds to the closure speed of the sack closure device, and wherein initially transporting the at least one filled sack at a horizontal transport speed horizontally out of an area beneath the filling nozzles, said filled sack being suspended by a transport means out of contact with the conveyor and depositing the sack on the conveyor belt and controlling the horizontal transport speed of the sack on the transport means such that the speed is greater than the travel speed of the conveyor belt.

2. A method according to claim 1 and transporting the at least one sack with the sack flap clamped in a suspended position out of the area beneath the filling nozzle.

3. A method according to claim 1 and transporting the at least one sack with the sack flap clamped in a supported position out of the area beneath the filling nozzle.

4. A method according to claim 2 horizontally transporting the at least one sack out of the area beneath the filling nozzle in an intermediate position in relation to a first height of the suspended position at the filling nozzle and a second height of an upright position on the conveyor belt.

5. A method according to claim 3 and transporting the at least one sack out of the area of the filling nozzle with the filled sack being supported and the sack flap relieved of tension.

6. A transfer device for conveying at least one sack out of a suspended position at an individual filling nozzle into an upright position on a conveyor belt for introduction into a sack closure device comprising:

a clamping arrangement with two pivotably supported approximately vertical arms including clamping strips extending horizontally in the direction of the opening edge of a sack, said arms are movable with their free ends with the aim of closing the clamping strips for the purpose of clamping the sack flap by means of the clamping strips beneath the filling nozzle;

a linear drive unit for the horizontal movement of the clamping arrangement in the direction of the conveyor belt, a lifting unit for raising and lowering the clamping arrangement; and a start end of the conveyor belt in relation to its direction of movement is located outside an area beneath the filling nozzles.

7. A device according to claim 6, wherein a support arrangement is provided with two horizontally closable support chucks which are capable of supporting the at least one sack, clamped by the clamping strips at the sack flap in the area of the sack body, and said support arrangement is capable of being moved horizontally in synchrony with the clamping arrangement by the linear drive unit.

8. A device according to claim 7, wherein the support chucks each include angle elements pointing inwards at each lower edge, on which the base of the sack being supported can rest.

9. A device according to claim 6, wherein a sack vibration device is arranged in an area beneath the filling nozzles, the height of said sack vibration device being adjustable.

* * * * *